US008276564B2

(12) United States Patent
Petruska

(10) Patent No.: US 8,276,564 B2
(45) Date of Patent: Oct. 2, 2012

(54) MULTIPLEXING DRIVE CIRCUIT FOR AN AC IGNITION SYSTEM

(75) Inventor: David C. Petruska, Fort Collins, CO (US)

(73) Assignee: Woodward, Inc., Fort Collins, CO (US)

( * ) Notice: Subject to any disclaimer, the term of this patent is extended or adjusted under 35 U.S.C. 154(b) by 663 days.

(21) Appl. No.: 12/542,794

(22) Filed: Aug. 18, 2009

(65) Prior Publication Data

US 2011/0041804 A1 Feb. 24, 2011

(51) Int. Cl.
*F02P 5/00* (2006.01)
*F23Q 3/00* (2006.01)

(52) U.S. Cl. ..... 123/406.12; 123/605; 361/263

(58) Field of Classification Search ..... 123/406.12, 123/594, 596, 604, 605, 609, 618, 620–623, 123/634, 635, 650, 651; 361/23, 256, 263; 315/209 CD, 222

See application file for complete search history.

(56) References Cited

U.S. PATENT DOCUMENTS

| | | | | |
|---|---|---|---|---|
| 4,245,609 | A | 1/1981 | Gerry | |
| 4,320,735 | A | 3/1982 | Canup | |
| 4,327,701 | A | 5/1982 | Gerry | |
| 4,998,526 | A | 3/1991 | Gokhale | |
| 5,113,839 | A | 5/1992 | Hartmann et al. | |
| 5,505,175 | A | 4/1996 | Mai et al. | |
| 6,123,057 | A * | 9/2000 | Goras et al. | 123/406.2 |
| 6,135,099 | A | 10/2000 | Marrs et al. | |
| 6,281,638 | B1 * | 8/2001 | Moisin | 315/244 |
| 6,528,956 | B2 * | 3/2003 | Barak | 315/291 |
| 6,696,840 | B2 * | 2/2004 | Ulmer | 324/380 |
| 7,404,396 | B2 | 7/2008 | Toriyama et al. | |
| 7,414,373 | B2 * | 8/2008 | Cho et al. | 315/307 |
| 2008/0121214 | A1 | 5/2008 | Bertsch et al. | |

FOREIGN PATENT DOCUMENTS

| | | | |
|---|---|---|---|
| KR | 2001-0045010 | A | 6/2001 |
| KR | 10-0442952 | B1 | 8/2004 |

* cited by examiner

*Primary Examiner* — John T. Kwon
*Assistant Examiner* — Johnny Hoang
(74) *Attorney, Agent, or Firm* — Reinhart Boerner Van Deuren P.C.

(57) ABSTRACT

A multiplexing drive circuit for an AC ignition system having a common leg that includes two switches coupled in series, and one or more dedicated legs, wherein each leg includes two switches coupled in series. The multiplexing drive circuit also includes a transformer for each of the one or more dedicated legs, each transformer having a primary winding coupled between one of the one or more dedicated legs and the common leg, and wherein each transformer has a secondary winding coupled in parallel to a spark plug, and a pulse-width modulated (PWM) switch controller configured to operate the common leg and dedicated leg switches to control characteristics of the spark discharge for the spark plug.

34 Claims, 4 Drawing Sheets

MULTIPLEXING DRIVE CIRCUIT FOR AN AC IGNITION SYSTEM

FIELD OF THE INVENTION

This invention relates generally to ignition systems for internal combustion engines and, more particularly, to ignition systems for internal combustion engines that use spark plugs.

BACKGROUND OF THE INVENTION

Typically, internal combustion engines include spark plugs along with spark-generating ignition circuitry to ignite an air-fuel mixture in the cylinder of the engine. Some engines employ permanent magnets attached to a rotating flywheel to generate a voltage on a charge coil. In a typical capacitive discharge system, electrical energy from a low voltage battery is fed into a power supply that steps it up to a higher voltage on a capacitor, which provides the voltage necessary to cause an electrical spark across the spark gap of a spark plug. The capacitor transfers its energy into the primary winding of an ignition coil and into the magnetic core of the ignition coil. Energy is extracted from the ignition coil secondary winding until the capacitor and magnetic core are absent of sufficient energy. In an inductive system, energy is pulled from a low-voltage battery in the primary of the coil. When the current is interrupted in the coil primary winding, a flyback occurs which initiates breakdown on the secondary winding and energy from the ignition coil core is extracted via the secondary winding. In both capacitive discharge and inductive ignition systems, energy is transferred to the magnetic core of the ignition coil through current flow in the primary winding of the ignition coil at a time $T_1$. At a later time $T_2$, the ignition coil secondary voltage and current are produced from the energy stored in the magnetic core. The ability to change secondary coil characteristics of open circuit voltage (OCV), current amplitude (CA), and spark duration (SD) are all related to changing the energy stored in the magnetic core of the coil. However, once energy has been placed in the magnetic core, the secondary coil characteristics are for the most part predetermined to be whatever the secondary load allows and cannot be changed until the next firing.

For a given inductive or capacitive discharge coil design, OCV, CA, and SD are directly proportional to stored energy. As the energy stored in the magnetic core is increased, all three of these values increase. The biggest constraint in these systems is open circuit voltage. This parameter always has to be large enough to reliably initiate a spark. So there is some minimum energy that is required to be applied to the coil so that there is reliable spark generation. For typical inductive and capacitive discharge ignition systems, the OCV is on the order of 25-40 kV. This limits the amount of adjustability in CA and SD that is available through adjusting energy application. Further, CA and SD must both increase or both decrease. In conventional inductive or capacitive discharge coil designs, these parameters cannot be adjusted independently. To modify the overall response of the ignition system, it is generally necessary to modify the coil design. And, typically, for a given coil design, the relationship between the OCV, CA, and SD cannot be optimized for different engine operating conditions.

As an alternative to capacitive discharge and inductive ignition systems, some engine systems employ alternating current ignition (AC) systems. In an AC ignition system, the alternating current is typically developed by a DC-to-AC inverter. There are several types of inverters that may be used in such a system. For example, an exemplary AC ignition system includes a transformer with a center-tapped primary coil and a secondary coil connected to a spark plug. An arc may be initiated at the spark plug by discharging a capacitor to one of the windings of the center-tapped primary coil. Both of the primary coil terminals are connected to a switch or transistor. The switches can be alternated between on and off to reverse the direction of current flow in the primary coil and, therefore, in the secondary coil. Control of these switches may be effected in a manner that facilitates adjustment of the CA or SD period.

However, AC ignition systems generally use more power semiconductors, such as switches and diodes, than capacitive discharge and inductive systems. Or, alternatively, the AC ignition requires ignition coils with more than two windings, such as a center tapped coil primary arrangement. Generally, as coil complexity decreases, the use of power semiconductors increases and vice versa. This makes AC ignition systems more costly to build and potentially less reliable as the additional components and increased complexity provide more points of possible failure. Further, many AC ignition systems do not permit precise real-time control of the secondary coil current, which determines the characteristics of the spark discharge.

It would therefore be desirable to have an alternating current ignition system that can be built less expensively using fewer components than conventional alternating current ignition systems and be able to fire a simple two-winding ignition coil. It would also be desirable to have an ignition system that allows for a greater degree of precise real-time control of the SD and CA than typically found in conventional inductive, capacitive discharge, or alternating current ignition systems.

Embodiments of the invention provide such an alternating current ignition system. These and other advantages of the invention, as well as additional inventive features, will be apparent from the description of the invention provided herein.

BRIEF SUMMARY OF THE INVENTION

In one aspect, an embodiment of the invention provides a multiplexing drive circuit for an AC ignition system having a common leg that includes two switches coupled in series, and one or more dedicated legs, wherein each dedicated leg includes two switches coupled in series. The AC ignition system also includes a transformer (with two-winding ignition coil) for each of the one or more dedicated legs, each transformer having a primary winding coupled between one of the one or more dedicated legs and the common leg. Furthermore, each transformer has a secondary winding coupled in parallel to a spark plug. The AC ignition system also includes a pulse-width modulated (PWM) switch controller configured to operate the common leg and dedicated leg switches to control characteristics of the spark discharge for the spark plug.

In another aspect, an embodiment of the invention provides a programmable AC ignition system that includes a DC electrical bus, a plurality of spark plugs, each coupled to a secondary winding of a respective transformer. Each transformer includes a primary winding having a first terminal coupled between a respective pair of dedicated switches coupled in series. The programmable AC ignition system also has a pair of shared switches coupled in series, wherein a second terminal of each primary winding is coupled between the shared switches, and wherein the shared switches and each of the dedicated switches are coupled to the DC bus. Further, the AC ignition system has a programmable controller configured to operate the shared switches and dedicated switches using pulse width modulation, wherein controlling the shared and dedicated switches comprises controlling spark discharge characteristics for the plurality of spark plugs.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
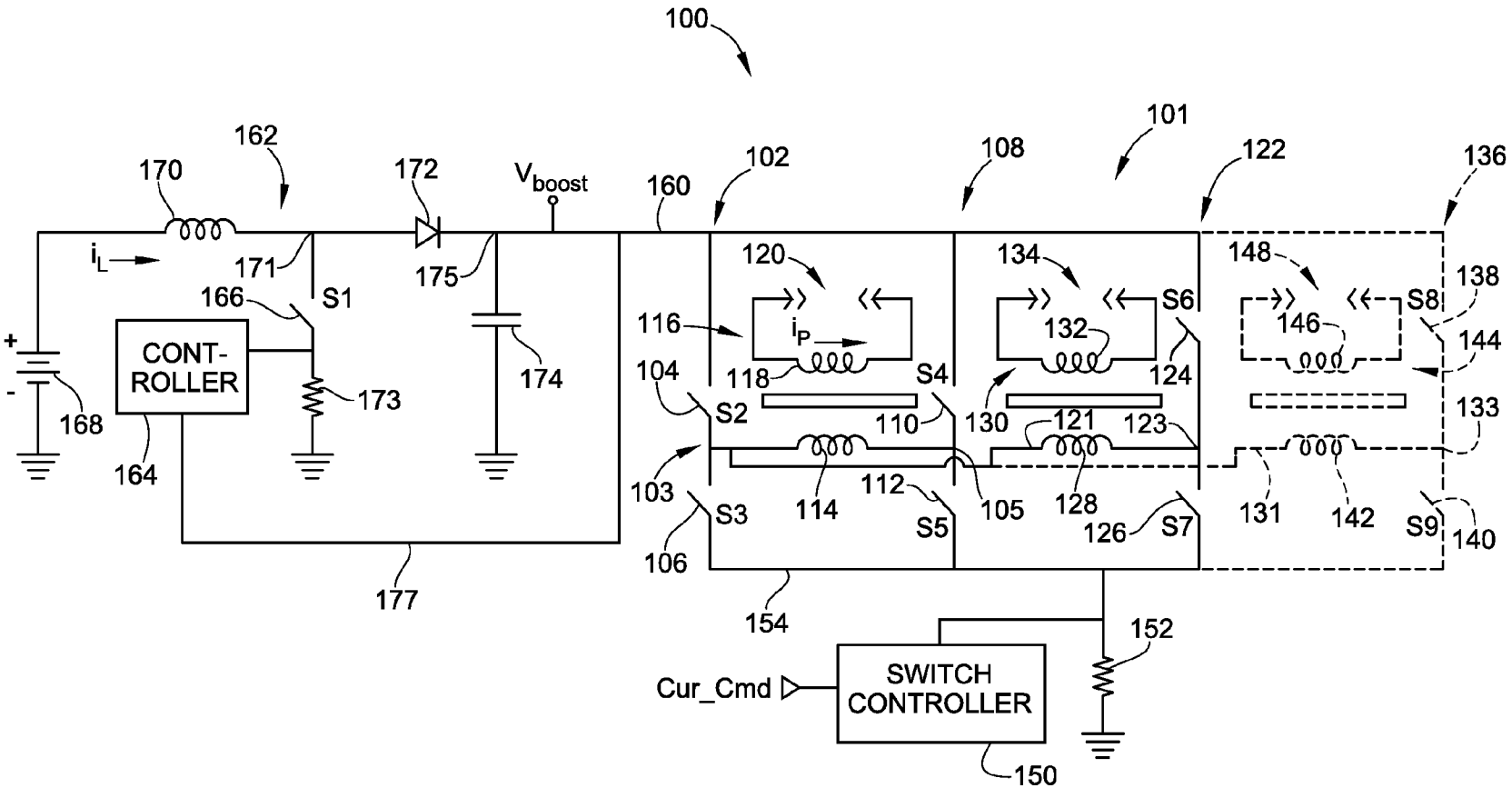
FIG. 1 is a schematic diagram of an AC ignition system module having a multiplexing drive circuit, according to an embodiment of the invention.

FIG. 1 illustrates an exemplary alternating current (AC) ignition system module 100 having a multiplexing drive circuit 101, according to an embodiment of the invention. Ignition system module 100 can be configured as a 3-channel, that is, coupled to three spark plugs, or a two-channel module, that is, coupled to two spark plugs, and includes a shared, or common, leg 102 having two switches S2, 104 and S3, 106 coupled in series. A first dedicated leg 108 has two switches S4, 110 and S5, 112 coupled in series. One terminal 103 of a primary winding 114 of a first ignition coil or transformer 116 is coupled between switches S2, 104 and S3, 106, while the other terminal 105 of the primary winding 114 is coupled between switches S4, 110 and S5, 112. A secondary winding 118 of the first transformer 116 is coupled in parallel with a first spark plug 120. Because the ignition coils in the present invention do not have to store as much energy as ignition coils in prior art ignition systems, the ignition system in the present invention can is configured to use ignition coils that are designed essentially to operate as high-voltage transformers rather than energy storage devices.

A second dedicated leg 122 includes two switches S6, 124 and S7, 126 coupled in series. The second dedicated leg 122 is coupled in parallel with the first dedicated leg 108 and the common, leg 102. A first terminal 121 of a primary winding 128 of a second ignition coil or transformer 130 is coupled between switches S2, 104 and S3, 106, while a second terminal 123 of primary winding 128 is coupled between switches S6, 124 and S7, 126. A secondary winding 132 of the second transformer 130 is coupled in parallel with a second spark plug 134.

In an alternate 3-channel embodiment of the invention, a third dedicated leg 136 (shown in phantom) includes two switches S8, 138 and S9, 140 coupled in series. One terminal 131 of a primary winding 142 of a third transformer 144 (shown in phantom) is coupled between switches S2, 104 and S3, 106, while the other terminal 133 of the primary winding 142 is coupled between switches S8, 138 and S9, 140. A secondary winding 146 of the third transformer 144 is coupled in parallel to a third spark plug 148.

As will be apparent from the following, the common leg 102 is referred to as the shared, or common, leg because it may be connected to more than one primary winding of the transformers for the spark plugs in the ignition system. The common leg 102 and the three dedicated legs 108, 122, 136 are each coupled in parallel. In contrast, each dedicated leg 108, 122, 136 is coupled to a different primary winding of a transformer. Each primary winding is coupled to a different spark plug.

In one embodiment, the switches are N-channel field effect transistors (FETs). In an alternate embodiment, the switches are metal oxide semiconductor field effect transistors (MOSFETs), and in another embodiment, the switches are insulated gate bipolar transistors (IGBTs). However, it is contemplated that other types of switches may be used as switches according to embodiments of the invention. In yet another embodiment of the invention, each of the one or more switches has a diode coupled in anti-parallel.

A pulse-width modulation (PWM) switch controller 150 is coupled to a current-sensing resistor 152 and to a neutral line 154, which connects to a common terminal of common leg 102 and of dedicated legs 108, 122, 136. In an embodiment of the invention, the PWM switch controller 150 is implemented as a field-programmable gate array (FPGA). When the switches are MOSFET or IGBT transistors, the PWM switch controller 150 is coupled to gates of the transistors to control switch operation. Further, the PWM switch controller 150 may be configured for high-frequency operation, 5-55 kilohertz, for example. The high-frequency operation of the switch controller 150 allows for precise control of the primary winding current level. A high coupling factor between the primary and secondary windings means that precise control of the primary winding current results in precise, and real time, control the secondary winding current. Such control of the secondary current enables the control of spark discharge characteristics, such as CA and SD. Accordingly, the PWM switch controller 150 is configured to alter these parameters for a particular spark discharge while the discharge is taking place.

In an embodiment of the invention, electrical energy for spark generation is drawn from a DC power bus 160 of DC-to-DC boost converter 162. The boost converter 162 includes a controller 164 that operates a switch S1 166. Through its control of switch S1 166, the controller 164 regulates the output voltage, that is, the DC power bus 160 voltage of the boost converter 162. A battery 168 supplies an electrical current to an inductor 170. The inductor terminal 171 opposite the battery 168 is coupled to a diode 172 and to the switch S1 166. The switch S1 166 is, in turn, coupled to a current sensing resistor 173 and to the controller 164. The diode terminal 175 opposite the inductor 170 is coupled to a capacitor 174, to the DC power bus 160, and to a voltage feedback line 177 coupled to the controller 164.

In an exemplary embodiment of the invention, the battery 168 supplies 24 volts DC, which is boosted to approximately 185 volts at the DC power bus 160. The switch S1 166 is modulated using pulse-width modulation in order to create a predetermined average current $I_L$. Current $I_L$ will have an AC ripple component (e.g., approximately ±6 amperes, for example) that is less than the DC component (approximately 34 amperes, for example). The current $I_L$ is a continuous, constant current when the boost converter 162 is "on." The current $I_L$ will provide packets of current through diode 172 to capacitor 174 when switch S1 166 is off during the S1 modulation when the boost converter 162 is "on." These packets of current will flow into capacitor 174 which will increase the voltage on the capacitor 174. The voltage feedback line 177 is used by the controller 164 to turn "of" the boost converter 162 at a predetermined voltage level (i.e., 185 volts). At this point, S1 modulation will cease and switch S1 166 will be left in an open state. The current $I_L$ will then start decreasing to zero. When the voltage $V_{boost}$ decreases to a second predetermined level, the boost converter 162 will turn "on" again and high frequency S1 modulation will be reinitiated in order to develop the appropriate DC current $I_L$ through the inductor 170, to maintain a stiff 185 volts on the DC bus.

For control of the spark characteristics in spark plug 120, switches S2 104 and S5 112 work together as a pair. They are either both on or both off. Switches S3 106 and S4 110 also work together as a pair and are operated in the inverse state of switches S2 104 and S5 112. The initial ionization of the spark plug gap in the first spark plug 120 is created by switching S3 106 and S4 110 on. In an exemplary embodiment, the transformers 116, 130, 144 have a primary winding to secondary winding turn ratio of approximately 1:180. When S3 106 and S4 110 turn on, the 185 volts on DC power bus 160 is placed across the primary winding 114. This places a high voltage across the secondary winding 118. When the voltage across the spark plug gap ($V_{SP}$) is sufficiently high (from 5 to 40 kilovolts, for example), the spark plug gap will ionize. At this point, the spark plug gap no longer looks like an open circuit, but rather more like a zener diode. As long as the secondary winding 118 of the transformer 116 is able to exceed the zener voltage, or sustaining voltage, of the spark plug gap, the spark gap will remain ionized and the spark discharge will continue. The sustaining voltage across the spark plug gap during spark discharge will drop, reducing $V_{SP}$ to a voltage between 300 volts and 3000 volts. The polarity of $V_{SP}$ is determined by the direction of current flow.

In the same manner as described above, switches S2 104 and S7 126 work together as a pair, either both on or both off. Switches S3 106 and S6 124 also work together as a pair and are operated in the inverse state of switches S2 104 and S7 126. Together, switches S2 104, S7 126, S3 106, and S6 124 are operated to control the spark discharge characteristics for the second spark plug 134. Similarly, switches S2 104 and S9 140 (shown in phantom) work together as a pair, either both on or both off. Switches S3 106 and S8 138 (shown in phantom) also work together as a pair and are operated in the inverse state of switches S2 104 and S9 140. Together, switches S2 104, S9 140, S3 106, and S8 138 are operated to control the spark discharge characteristics for the third spark plug 148.

During operation of the AC ignition system, a current $I_P$ flows through the primary coil 114 when switches S2 104 and S5 112 are on (i.e., closed). When $I_P$ reaches a predetermined level (30 to 150 amperes, for example), the switch controller 150 turns S2 104 and S5 112 off, while turning switches S3 106 and S4 110 on. When switches S3 106 and S4 110 are on, the current $I_P$ through the primary winding 114 changes direction, thus defining the AC operation of the ignition system. Switches S3 106 and S4 110 will be held in an on state until the current $I_P$ reaches a predetermined value of equal magnitude but opposite polarity of the S2 104 and S5 112 switch peak current. Thus, the current $I_P$ takes on a high-frequency triangular shape. The current $I_S$ that flows in the secondary winding is of the same shape and phase as the primary winding current $I_P$ but scaled based on the primary winding to secondary winding turn ratio.

The transformers 116, 130, 144 have low-inductance primary and secondary windings relative to the windings found on typical ignition coils. The low inductance of the primary and secondary windings of the three transformers, shown in FIG. 1, allows for tight coupling of the primary winding current and the secondary winding current. The low inductances also allow for precision control of the primary winding and secondary winding currents. By precisely controlling the primary winding current, the secondary winding current is also precisely controlled.

In an exemplary embodiment of the invention, the transformers have a primary inductance of approximately 109 microhenries, a secondary inductance of approximately 3.7 henries, a primary leakage inductance of approximately 28 microhenries, and a secondary leakage inductance of approximately 0.95 henries. Additionally, the transformers have a primary coupling factor of approximately 0.8630, a secondary coupling ratio of approximately 0.8630, and a turns ratio of approximately 184 to one. The time rate of change in the current through the primary and secondary windings of the transformer is dictated by the leakage inductances or coupling factors. The coupling factor can be determined according to the following equation:

$$1-k^2=L_{ps}/L_p=L_{sp}/L_s, \quad (1)$$

where k is the coupling factor, $L_P$ is the primary inductance with the secondary open, $L_s$ is the secondary inductance with the primary open, $L_{ps}$ is the primary inductance with the secondary shorted (leakage at primary), and $L_{sp}$ is the secondary inductance with the primary shorted (leakage at secondary). This sets the frequency of oscillation for a given current setting. As the current value increases, the frequency decreases. When coupled to a 185-volt nominal bus, this transformer oscillates at approximately 12 kHz to 55 kHz as the output current level decreases from 300 mA (rms) to 65 mA (rms). With respect to the inductances and coupling factors discussed herein, "approximately" is defined as plus or minus 25%, as a number of factors can affect these values, including inter-winding capacitance, skin effects, proximity effects, measurement methods, and product variation.

In another exemplary embodiment of the invention, the transformers have a primary inductance of approximately 246 microhenries, a secondary inductance of approximately 8.11 henries, a primary leakage inductance of approximately 61 microhenries, and a secondary leakage inductance of approximately 2.04 henries. Additionally, the transformers have a primary coupling factor of approximately 0.8672, a secondary coupling ratio of approximately 0.8651, and a turns ratio of approximately 182 to one. When coupled to a 185-volt nominal bus, this transformer oscillates at approximately 5 kHz to 29 kHz as the output current level decreases from 300 mA (rms) to 65 mA (rms).

Figure 2A:
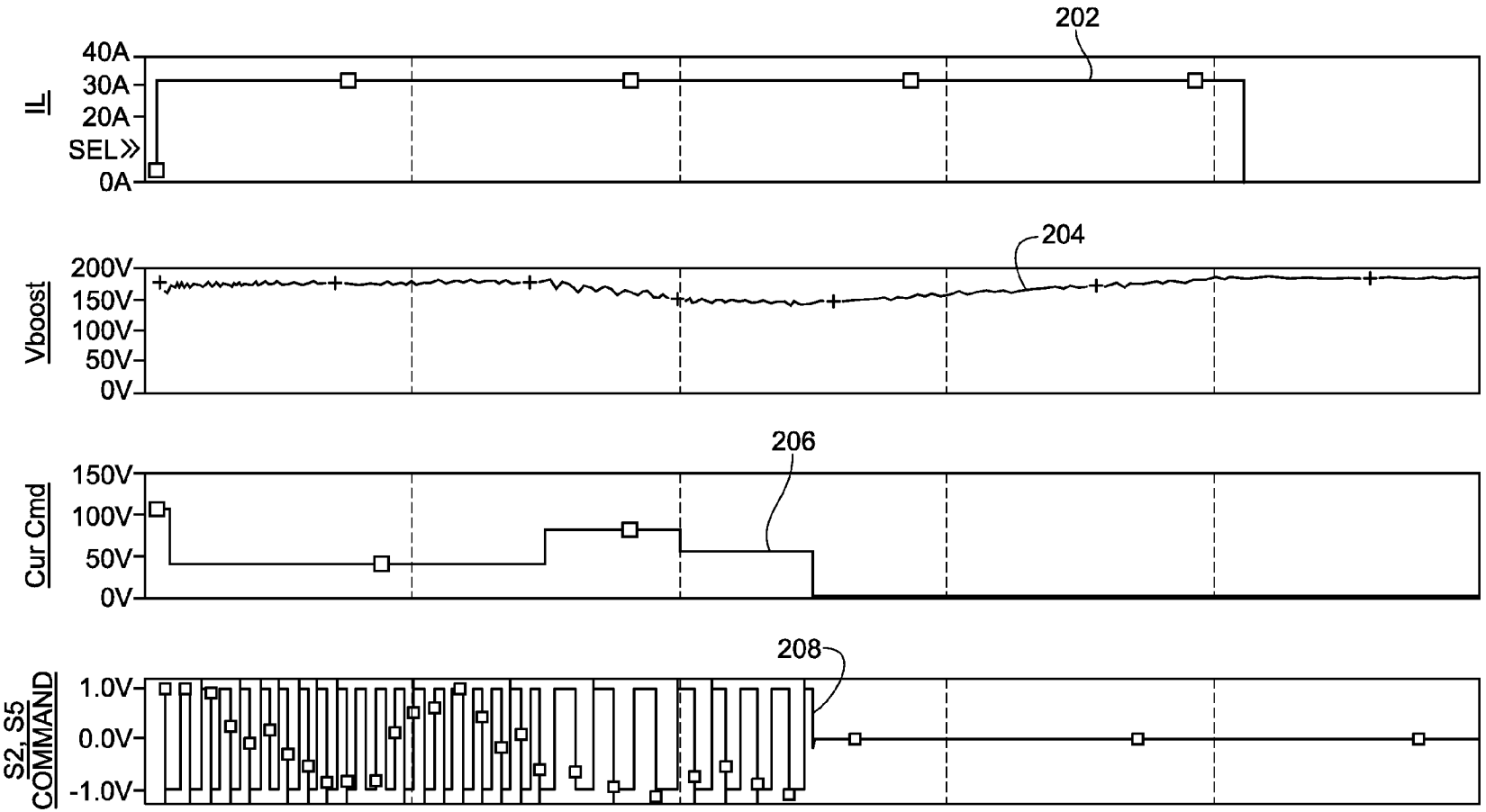
FIGS. 2A and 2B are timing diagrams showing the basic voltage and current waveforms during exemplary operation of the ignition system of FIG. 1.
Figure 2B:
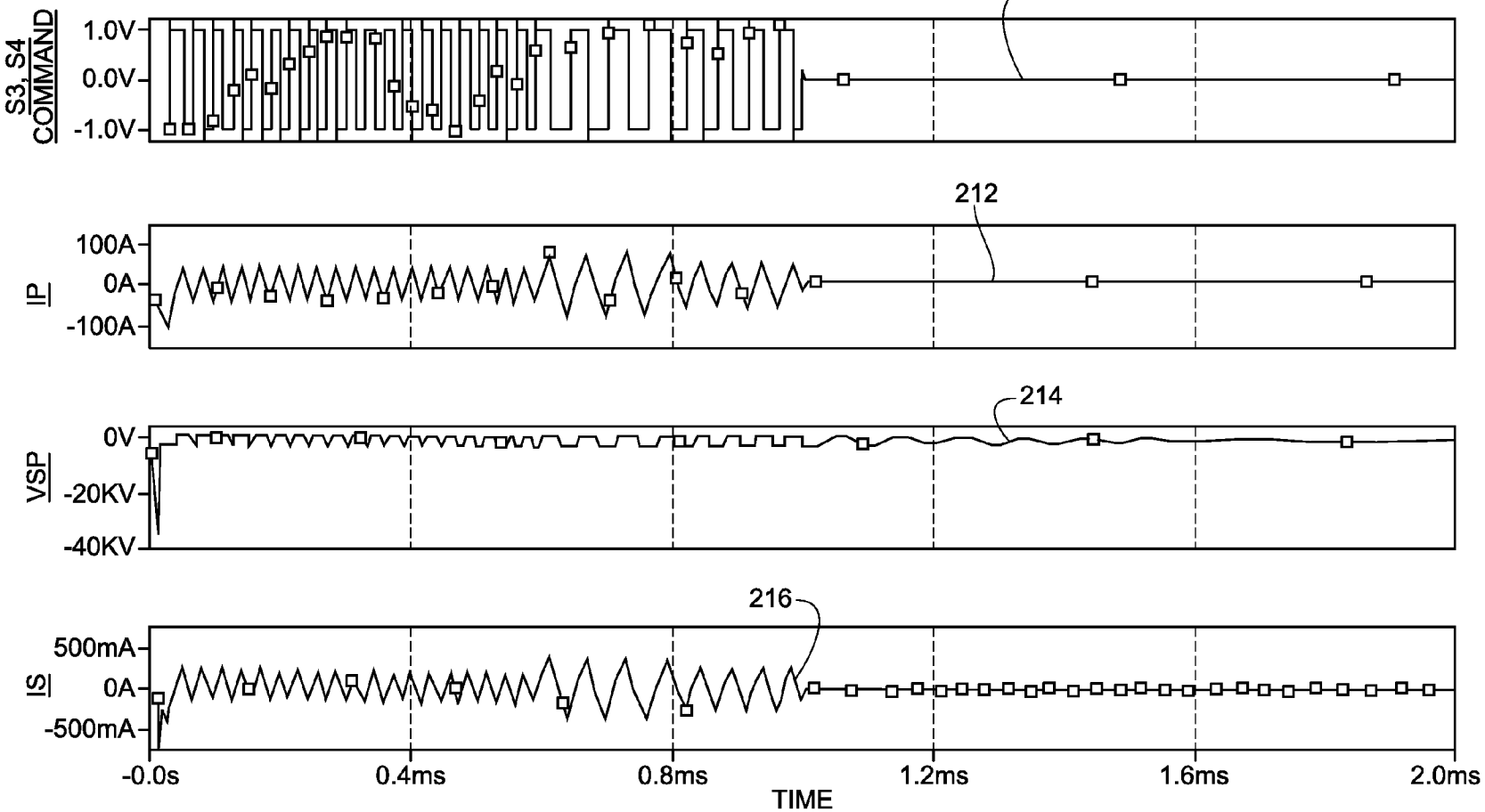

FIGS. 2A and 2B are timing diagrams that illustrates the basic voltage and current waveforms during intended operation of the ignition system module 100 of FIG. 1. The $I_L$ waveform 202 shows the input current to the boost converter. The small ripple is not apparent in this simulation output. Note the $I_L$ is off at time equal to zero. When the voltage $V_{boost}$ decrease below 180 volts, $I_L$ starts to conduct, $I_L$ continues to conduct even after the spark is turned off at the 1 msec point. Current $I_L$ flows until $V_{boost}$ is back to 185 volts.

The $V_{boost}$ waveform 204 shows the 185 volts DC output voltage of the boost converter. There is some voltage sag during the heavy loading of the ignition event. However, the basic concept of this scheme is for the voltage $V_{boost}$ to be a constant value. The voltage sag shown in the simulation is a result of non-ideal or pragmatic power supply design choices.

The Cur_Cmd waveform 206 shows the AC magnitude commanded for the primary current $I_P$. Note that the peaks of the current $I_P$ correspond to the Cur_Cmd trace. Also note that Cur_Cmd can be changed nearly instantaneously, as shown in FIGS. 2A and 2B, with a corresponding, and nearly instantaneous, response of $I_P$.

An S2, S5 Command waveform 208 shows the state of switches S2 104 and S5 112. When the signal is +1 (high), the switches 104, 112 are closed. When the signal is −1 (low), the switches 104, 112 are open. An S3, S4 Command waveform 210 shows the state of switches S3 106 and 110 S4. When the signal is +1 (high) the switches 106, 110 are on. When the signal is −1 (low), the switches 106, 110 are off. Note that the S2, S5 Command waveform 208 is out of phase with the S3, S4 Command waveform 210.

The $I_P$ waveform 212 shows the ignition coil primary current. Note that this current has a triangular AC shape. The magnitude of the AC current is determined by the Cur_Cmd signal. The frequency of the AC current is result of the $V_{boost}$, LP, and Cur_Cmd. As the magnitude of Cur_Cmd increases, the frequency decreases. During breakdown the Cur_Cmd is approximately 100 amperes. After breakdown, Cur_Cmd is changed to approximately 50 amperes. At 600 μsec and 800 μsec, Cur_Cmd is changed and $I_P$ responds accordingly.

The $V_{SP}$ waveform 214 shows the voltage at the spark plug electrodes. Note that the breakdown in this simulation occurs at approximately 35 kilovolts. After which, $V_{SP}$ is reduced to the sustaining voltage which has a magnitude of approximately 1000 volts in this simulation. Also note that the polarity of $V_{SP}$ is determined by the direction of current Is.

The Current $I_S$ waveform 216 is a scaled reflection of $I_P$ (i.e., a triangle wave) per the turns ratio in the ignition coil. Current $I_S$ and the ability to instantaneously change its magnitude is a feature of the embodiment shown in FIG. 1. Note that the first negative peak is quite high and follows the Cur_Cmd waveform 206. After breakdown Cur_Cmd is reduced and the amplitude of $I_S$ reduces accordingly. At approximately 600 μsec, Cur_Cmd steps higher and so does the amplitude of current $I_S$. At approximately 800 μsec, Cur_Cmd is changed again and so is current $I_S$. At approximately 1000 μsec, Cur_Cmd goes to zero and $I_S$ stops flowing. This causes termination of the spark.

The programmability of spark discharge characteristics in the present invention allows for the choice of a wide range of CAs and SDs. For example, an embodiment of the invention allows for spark discharge times to programmed over a range of 0.1 to 4.0 milliseconds, and for the CA to be programmed over a range of 50 to 1000 milliamps. This, in turn, allows for a single ignition system design to be used in a number of different engine designs and configurations. Rather than designing and manufacturing an entire family of ignition systems for different engines, the present invention contemplates one ignition system design that can be programmed to work with many different models of engine.

The programmability of the ignition system described herein also facilitates a longer useful life for the spark plugs used in the system. Over the lifetime of an engine, the replacement of spark plugs can be a costly and time-consuming aspect of the engine's overall maintenance. In a typical spark plug, the spark gap increases as the electrodes become worn. Over time, this may lead to an increase in both the breakdown voltage and sustaining voltage. Other factors, such as break mean effective pressure, which can increase with engine load may also influence in-cylinder conditions including the spark discharge characteristics during engine operation. It is also possible for the user to intentionally vary certain engine parameters that affect spark discharge characteristics. Changes, such as these, can be detected by the switch controller 150, which can then add energy to the spark during the spark discharge, if necessary, to keep the spark characteristics within acceptable operational limits. This is accomplished by tightly coupling the primary and secondary currents. In embodiments of the present invention, the secondary current can be controlled in real time via control of the primary current.

On an engine having 16 spark plugs, for example, a multiplexing 16-channel system channel AC ignition system includes 16 dedicated legs with 32 switches, and, typically, six common legs with 12 switches. When the switches are implemented as N-channel FETs, gate drives are used to translate the logic from the switch controller to a drive level sufficient to operate the switches. In one embodiment, 22 half bridge drivers are used to drive the 44 FETs in a 16-channel ignition system. Each common leg is coupled to a respective boost converter, and all 44 switches may be controlled by one PWM controller.

In a reciprocating engine, the cylinders are typically fired in a predetermined sequence. It is possible for there to be an overlap between adjacent firings. The possibility of such an overlap increases as the number of cylinders increase, as spark duration increases, and is more likely in engines with non-symmetric firing sequences. For example, a 16-cylinder, 4-stroke engine with a symmetric firing sequence fires an output every 45 degrees, i.e., 720 degrees/16=45 degrees. At 1800 RPM, one degree=92.59 microseconds, resulting in an output being fired once every 4.167 milliseconds. If the maximum spark duration is 2 milliseconds, for example, there will be no overlap in firings.

Figure 3:
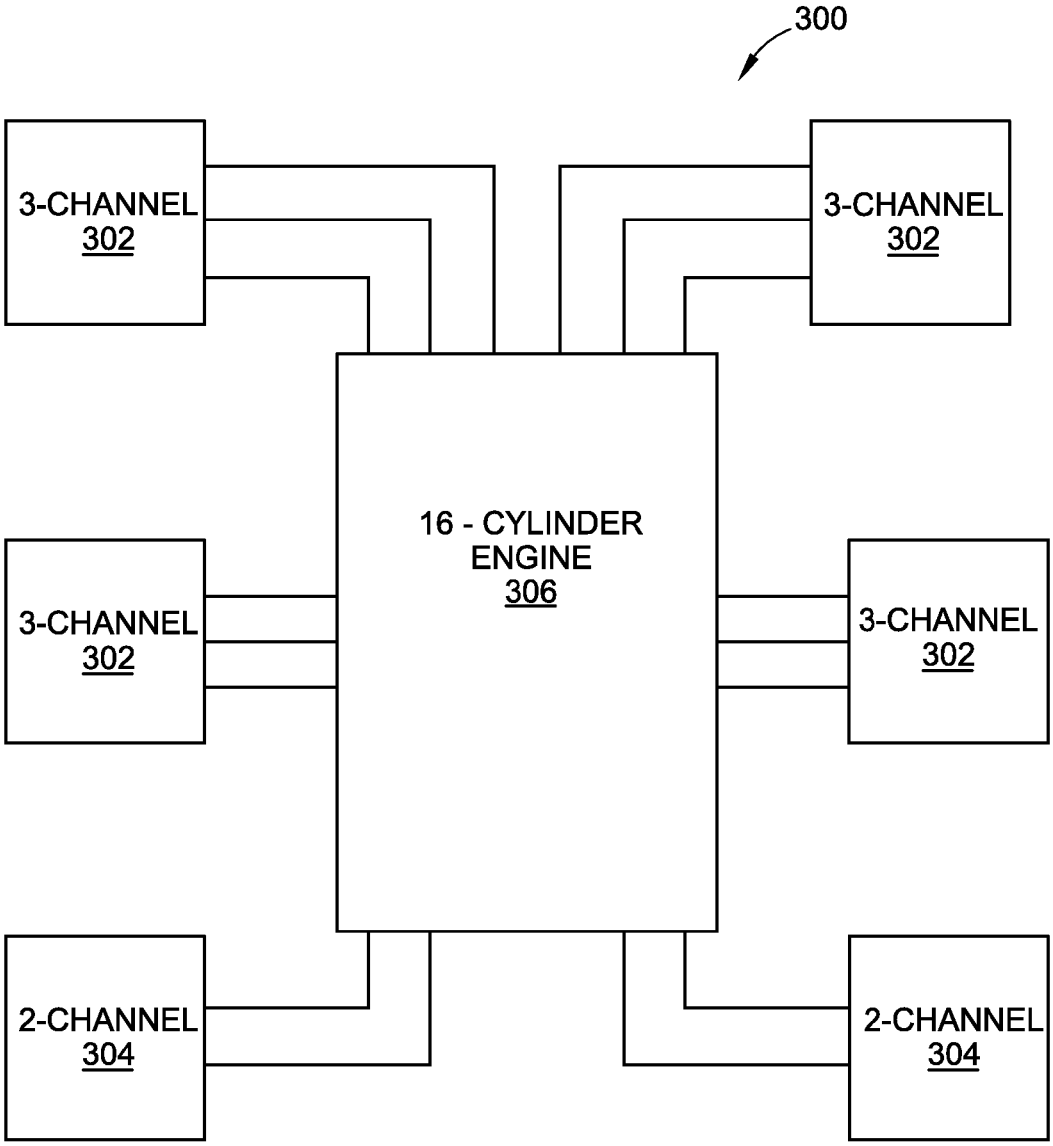
FIG. 3 is a block diagram of a 16-channel AC ignition system with multiplexing drive circuits according to an embodiment of the invention.

However, in a 16-cylinder engine with a 15-75 non-symmetric firing sequence may have such an overlap in the firing. At 1800 RPM, there is 1.39 milliseconds for those parts of the sequence with 15 degrees between firings. In this case, some overlap is possible if the spark duration is 2 milliseconds. FIG. 3 illustrates an exemplary 16-channel ignition system 300 having four 3-channel ignition system modules 302 of the type shown in FIG. 1, wherein the module includes the elements shown in phantom. Ignition system 300 further includes two 2-channel ignition system modules 304 of the type shown in FIG. 1, wherein the module does not include the elements shown in phantom. The four 3-channel ignition system modules 302 and two 2-channel ignition system modules connect to 16 spark plugs in an engine 306. A conventional non-multiplexing AC ignition system might require 64 switches (four per spark plug) to operate the 16-cylinder engine 306. However, the multiplexing feature of ignition system 300 allows the same 16-cylinder engine 306 to be operated using 44 switches. The dedicated legs of the ignition system modules 302, 304 use 32 switches, while the shared legs in those modules use 12 switches. A common switch controller 150 (shown in FIG. 1) may be used to operate all 44 switches.

This design, in which the switch controller 150 regulates precisely the level of current in the primary winding of each transformer, allows CA to be controlled independently of the SD, while maintaining the same OCV. Moreover, embodiments of the present invention manage to implement the aforementioned ignition-system features without employing costly design schemes, i.e., without center-tapped transformers, high-voltage, high-current semiconductors, resonant circuits, or high-energy-storage ignition coils.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended here to as permitted by applicable law. Moreover, any combination of the above-described elements in all possible variations thereof is encompassed by the invention unless otherwise indicated herein or otherwise clearly contradicted by context.

What is claimed is:

1. A multiplexing drive circuit for an AC ignition system module comprising:

a common leg that includes two switches coupled in series;

one or more dedicated legs, wherein each dedicated leg includes two switches coupled in series;

a transformer for each of the one or more dedicated legs, each transformer having a primary winding coupled between one of the one or more dedicated legs and the common leg, and wherein each transformer has a secondary winding coupled in parallel to a spark plug;

a pulse-width modulated (PWM) switch controller configured to operate the common leg and dedicated leg switches to control characteristics of the spark discharge for the spark plug.

2. The multiplexing drive circuit of claim 1, wherein the one or more dedicated legs comprise two dedicated legs.

3. The multiplexing drive circuit of claim 1, wherein the one or more dedicated legs comprise three dedicated legs.

4. The multiplexing drive circuit of claim 1, further comprising a DC-to-DC boost converter configured to provide electrical energy to generate the spark discharge.

5. The multiplexing drive circuit of claim 1, wherein the switches are one of N-channel FETs and MOSFETs.

6. The multiplexing drive circuit of claim 5, wherein each switch is coupled to a diode in anti-parallel.

7. The multiplexing drive circuit of claim 1, wherein the switch controller uses high-frequency pulse width modulation, wherein controlling the shared and dedicated switches comprises controlling spark discharge characteristics for the plurality of spark plugs; and wherein the controller is configured to alter the characteristics of a particular spark discharge while the spark discharge is taking place.

8. The multiplexing drive circuit of claim 1, wherein the spark discharge time can be programmed to have a duration of 0.1 millisecond to 4 milliseconds, and the secondary winding current amplitude is programmed to have a range of 50 milliamps to 1000 milliamps.

9. The multiplexing drive circuit of claim 1, wherein each transformer has a primary inductance of approximately 109 microhenries, and a secondary inductance of approximately 3.7 henries.

10. The multiplexing drive circuit of claim 9, wherein each transformer has a primary leakage inductance of approximately 28 microhenries, and a secondary leakage inductance of approximately 0.95 henries.

11. The multiplexing drive circuit of claim 10, wherein each transformer has a primary coupling factor of approximately 0.8630, and a secondary coupling factor of approximately 0.8630.

12. The multiplexing drive circuit of claim 11, wherein each transformer oscillates at approximately 12 kHz to 55 kHz as the output current level goes from 300 mA (rms) to 65 mA (rms).

13. The multiplexing drive circuit of claim 1, wherein each transformer has a primary inductance of approximately 246 microhenries, and a secondary inductance of approximately 8.1 henries, and wherein each transformer has a primary leakage inductance of approximately 61 microhenries, and a secondary leakage inductance of approximately 2.04 henries.

14. The multiplexing drive circuit of claim 13, wherein each transformer has a primary coupling factor of approximately 0.8672, and a secondary coupling factor of approximately 0.8651, wherein each transformer oscillates at approximately 5 kHz to 29 kHz as the output current level goes from 300 mA (rms) to 65 mA (rms).

15. The multiplexing drive circuit of claim 1, wherein the common leg switches and the dedicated leg switches are operated to generate a flow of alternating current through each of the secondary windings.

16. The multiplexing drive circuit of claim 1, wherein spark discharge in a spark plug is terminated by opening the two common leg switches and the two dedicated leg switches for that spark plug.

17. A programmable AC ignition system module comprising:

a DC electrical bus;

a plurality of spark plugs, each coupled to a secondary winding of a respective transformer, wherein each transformer includes a primary winding having a first terminal coupled between a respective pair of dedicated switches coupled in series;

a pair of shared switches coupled in series wherein a second terminal of each primary winding is coupled between the shared switches;

wherein the shared switches and each of the dedicated switches are coupled to the DC bus; and a programmable controller configured to operate the shared switches and dedicated switches using pulse width modulation, wherein controlling the shared and dedicated switches comprises controlling spark discharge characteristics for the plurality of spark plugs.

18. The AC ignition system module of claim 17, further comprising a boost converter configured to output a DC voltage to the DC bus.

19. The AC ignition system of module claim 17, wherein controlling the spark discharge characteristics comprises independent control of current amplitude and spark discharge period.

20. The AC ignition system module of claim 17, wherein the shared switches and dedicated switches are MOSFETs, and wherein each MOSFET is coupled to a diode in anti-parallel.

21. The AC ignition system module of claim 17, wherein the shared switches are coupled to the primary windings of at least two transformers.

22. The AC ignition system module of claim 17, wherein the share switches are coupled to the primary windings of at least three transformers.

23. The AC ignition system module of claim 17, wherein each transformer has a primary inductance of approximately 109 microhenries, and a secondary inductance of approximately 3.7 henries, and wherein each transformer has a primary leakage inductance of approximately 28 microhenries, and a secondary leakage inductance of approximately 0.95 henries.

24. The AC ignition system module of claim 23, wherein each transformer has a primary coupling factor of approximately 0.8630, and a secondary coupling factor of approximately 0.8630, and wherein each transformer oscillates at approximately 12 kHz to 55 kHz as the output current level goes from 300 mA (rms) to 65 mA (rms).

25. The AC ignition system module of claim 17, wherein each transformer has a primary inductance of approximately 246 microhenries, and a secondary inductance of approximately 8.11 henries.

26. The AC ignition system module of claim 25, wherein each transformer has a primary leakage inductance of approximately 61 microhenries, and a secondary leakage inductance of approximately 2.04 henries.

27. The AC ignition system of module claim 26, wherein each transformer has a primary coupling factor of approximately 0.8672, and a secondary coupling factor of approximately 0.8651.

28. The AC ignition system module of claim 27, wherein each transformer oscillates at approximately 5 kHz to 29 kHz as the output current level goes from 300 mA (rms) to 65 mA (rms).

29. The AC ignition system module of claim 17, wherein the shared switches and dedicated switches are IGBTs, and wherein each IGBT is coupled to a diode in anti-parallel.

30. The AC ignition system module of claim 17, wherein the controller uses high-frequency pulse-width modulation to control the shared switches and dedicated switches, and wherein the controller is configured to alter the characteristics of a particular spark discharge while the spark discharge is taking place.

31. The AC ignition system module of claim 29, wherein the spark discharge time is programmed to have a duration of from 0.1 millisecond to 4 milliseconds.

32. A 16-channel ignition system comprising:

four three-channel ignition system modules and two two-channel ignition system modules, wherein each ignition system module comprises:

a DC electrical bus;

a plurality of spark plugs, each coupled to a secondary winding of a respective transformer, wherein each transformer includes a primary winding having a first terminal coupled between a respective pair of dedicated switches coupled in series;

a pair of shared switches coupled in series wherein a second terminal of each primary winding is coupled between the shared switches;

wherein the shared switches and each of the dedicated switches are coupled to the DC bus; and a programmable controller configured to operate the shared switches and dedicated switches in each of the ignition system modules using pulse width modulation, wherein controlling the shared and dedicated switches comprises controlling spark discharge characteristics for the plurality of spark plugs.

33. The 16-channel ignition system of claim 32, wherein the programmable controller is an FPGA.

34. The 16-channel ignition system of claim 32, wherein the system has 32 dedicated switches and 12 shared switches.

* * * * *